US007325339B2

(12) United States Patent
Jordan

(10) Patent No.: US 7,325,339 B2
(45) Date of Patent: Feb. 5, 2008

(54) APPARATUS FOR POSITIONING AND MOUNTING AWARDS

(76) Inventor: James G. Jordan, 838 Pine Ave., #417, Long Beach, CA (US) 90813

( * ) Notice: Subject to any disclaimer, the term of this patent is extended or adjusted under 35 U.S.C. 154(b) by 214 days.

(21) Appl. No.: 11/024,890

(22) Filed: Dec. 29, 2004

(65) Prior Publication Data

US 2006/0137229 A1 Jun. 29, 2006

(51) Int. Cl.
*A44C 3/00* (2006.01)

(52) U.S. Cl. ..... 40/1.5; 40/622; 24/303

(58) Field of Classification Search ..... None
See application file for complete search history.

(56) References Cited

U.S. PATENT DOCUMENTS

| | | | | | |
|---|---|---|---|---|---|
| 520,621 | A * | 5/1894 | Stowe | 24/114.4 |
| 1,183,392 | A * | 5/1916 | Meek | 24/13 |
| 1,235,580 | A * | 8/1917 | McDougall | 40/1.5 |
| 1,569,443 | A * | 1/1926 | Weed | 40/1.5 |
| 1,624,458 | A * | 4/1927 | Zook | 40/1.5 |
| 1,690,129 | A * | 11/1928 | Prentiss | 24/114.4 |
| 2,144,926 | A * | 1/1939 | Lawton | 40/1.5 |
| 2,392,351 | A * | 1/1946 | Wolf | 40/1.5 |
| 2,396,160 | A * | 3/1946 | Coulter et al. | 40/1.5 |
| 2,413,056 | A * | 12/1946 | Levyn | 40/1.5 |
| 2,464,395 | A * | 3/1949 | Hilborn | 40/1.5 |
| 2,495,577 | A * | 1/1950 | Elkies | 40/1.6 |
| 2,551,196 | A * | 5/1951 | Ballou, Jr. | 24/108 |
| 2,625,757 | A * | 1/1953 | Wolf | 40/1.5 |
| 2,707,344 | A * | 5/1955 | Bolognese | 40/1.5 |
| 2,730,824 | A * | 1/1956 | Cohen | 40/1.5 |
| 2,795,876 | A * | 6/1957 | Hayes | 40/1.5 |
| 2,821,787 | A * | 2/1958 | Shepard | 33/653 |
| 2,832,161 | A * | 4/1958 | Murpjy | 40/1.5 |
| 2,834,129 | A * | 5/1958 | Kirkbridge | 40/1.5 |
| 2,847,773 | A * | 8/1958 | Herrick | 40/1.5 |
| 2,902,782 | A * | 9/1959 | Coleman | 40/1.5 |
| 3,009,381 | A * | 11/1961 | Rapata | 411/337 |
| 3,192,655 | A * | 7/1965 | Harn | 40/1.5 |
| 3,193,956 | A * | 7/1965 | Przbysiski | 40/1.5 |
| 3,455,042 | A * | 7/1969 | Carr et al. | 40/1.5 |
| 3,546,797 | A * | 12/1970 | Oleson | 40/1.5 |
| 3,579,881 | A * | 5/1971 | Cherry | 40/1.5 |
| 3,942,273 | A * | 3/1976 | Adams | 40/1.5 |
| 4,137,657 | A * | 2/1979 | Wardle | 40/1.5 |
| 4,357,767 | A * | 11/1982 | Ross | 40/1.5 |
| D311,708 | S * | 10/1990 | Rankin | D11/95 |
| 5,946,732 | A * | 9/1999 | Richards | 2/247 |
| 6,122,805 | A * | 9/2000 | Haegley | 24/114.4 |
| 6,510,629 | B1 * | 1/2003 | Smidt et al. | 40/1.5 |
| 6,526,679 | B1 * | 3/2003 | Wood | 40/1.5 |
| 6,766,603 | B1 * | 7/2004 | Perrone | 40/1.6 |
| 7,010,875 | B1 * | 3/2006 | Perrone | 40/1.5 |
| 7,096,614 | B1 * | 8/2006 | Williams | 40/1.5 |
| 2006/0117617 | A1 * | 6/2006 | Peterson et al. | 40/1.6 |

* cited by examiner

*Primary Examiner*—Jack W. Lavinder
(74) *Attorney, Agent, or Firm*—Fulwider Patton LLP

(57) ABSTRACT

An apparatus for displaying ribbons and badges on a garment wherein predetermined arrangements of awards can be quickly and reliably established using designated openings in a template. Using break-away portions, the template can be sized as needed and pin holes are preferably used to mount ribbons having a marking implement such as a pin to secure the ribbon to a uniform. A separate badge positioning section includes horizontal slots preferably slightly offset vertically with a portion of said horizontal slots co-linear.

7 Claims, 5 Drawing Sheets

APPARATUS FOR POSITIONING AND MOUNTING AWARDS

FIELD OF THE INVENTION

The present invention relates to an apparatus for attaching items to apparel, and more particularly, to an apparatus for attaching ribbons and medals and the like onto a uniform for display.

BACKGROUND OF THE INVENTION

For police, fire, and other civil service careers, formal events and ceremonies often require the donning of formal uniforms including the display of any commendations obtained in the line of duty. This is even more prevalent in the military where formal uniform apparel is more commonly worn. Such uniforms typically include a pair of pants, dress shirt, and covering jacket. The display of any medals, ribbons, or badges may be strictly regulated in certain situations. In particular, regulations exists pertaining to the spacing and positioning of the commendations on the uniform. Depending on the number of commendations, it can take a considerable amount of time to correctly comply with the various specifications and regulations on the placement and spacing of the commendations. Incorrect placement is unacceptable, particularly in military applications, but performing this process repeatedly each time dress formals are worn would consume a significant amount of time. In addition, different occasions call for different sets of medals to be worn. Also, the addition of new awards may necessitate an entirely different arrangement or spacing requirement.

In addition to the spacing and time concerns, the typical medals include a pin for piercing the shirt or dress jacket. A clamping mechanism worn on the inside of the jacket or shirt secures the medals to the garment. These securing devices may cause discomfort to the wearer and damage the garment.

One crude device frequently used to located the awards is a piece of leather or cardboard secured to the inside of the jacket or shirt. However, both leather and cardboard degrade over time and the holes do not retain a precise placement location as hole size become larger or otherwise loses its shape. Cardboard has a particularly limited life due to its paper construction. In addition, the pins on the back of the ribbons and medals can pierce the cardboard or leather in any location and are not restricted to certain locations on the back piece. Thus, precise placement using these materials remains difficult.

One device purportedly used to secure ribbons and the like can be found in U.S. Pat. No. 6,122,805 to Haegley. In that patent, a securing device located on the inside of a uniform garment includes clasps encased within a soft foam material for repeated insertion by a pin. However, Haegley's device requires that the clasps be permanently fixed in the foam material so adjustment is precluded for accommodating different sizes of awards. Further, soft foam material will erode from repeated uses limiting the effectiveness of the device.

Accordingly, it has been demonstrated that there is a need in the art for an apparatus that can simply and quickly mount awards such as medals and ribbons to a uniform in a precise but variable manner that does not result in discomfort to the bearer of the awards and yields a reliable and timesaving procedure for arranging the awards on a uniform.

SUMMARY OF THE INVENTION

The present invention is directed to an award template for positioning and supporting a plurality of awards such as ribbons and badges to be worn on a uniform. The template may be generally in the form of a plate having a badge positioning section and a ribbon positioning section. Each section further comprises a positioning aspect that receives a fastening implement on the back of an award for positioning a set of ribbons and badges in relation to a predetermined location on a garment, such as the top edge of a pocket on a shirt or jacket. Other aspects of the present invention will become apparent with further reference to the following drawings and specification.

DETAILED DESCRIPTION OF THE INVENTION

Figure 1:
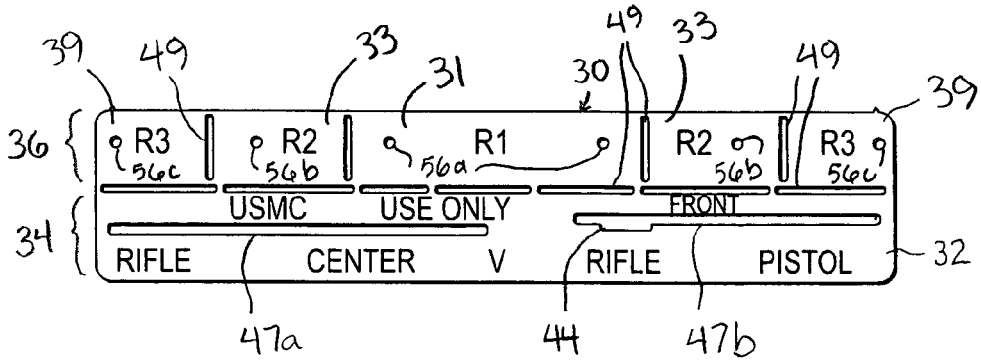
FIG. 1 is a front view of a template in accordance with a first embodiment of the present invention.

Referring to FIG. 1, an award template, generally designated 30, for positioning and supporting a plurality of ribbons and badges on a uniform or the like is illustrated. This template, which may also be referred to as a bracket, is used to create what is commonly referred to as a Type 1 Alpha style arrangement as illustrated. The template 30 may be made of brass, however other suitable materials including other metals such as marine grade aluminum and other corrosive resistant materials as well as other materials including plastic or Plexiglas® material may be used. The template 30 supports up to 1 to 3 ribbons and may optionally support 1 or 2 badges. The Alpha style bracket is constructed to provide a ⅛" spacing between ribbons, while a Bravo style bracket is constructed to provide for flush mounting the ribbons corresponding to Army and Air Force regulations, respectively. In general terms, the template is in the form of a smooth flat plate 32 including a badge positioning section 34 and a ribbon positioning section 36. The ribbon positioning section is comprised of an inner portion 31 designated R1, intermediate portions 33 designated R2, and outer portions 39 designated R3. Intermediate and outer portions 33, 39 are removable to customize the ribbon positioning section to the necessary lengths by snapping off or otherwise excising the unwanted portions of the template. The inner portion 31, intermediate portions 33 and outer portions 39 include pin holes 56 that are sized to receive positioning pins on the back of the ribbons to be worn on the template. For example, if a ribbon is to be positioned in the inner area R1, pin holes 56*a* are used to mount the medal by receiving left and right pins supporting the medal and portions R2 and R3 are removed. If, conversely, the intermediate portion R2 is used, then pin holes 56*b* are employed and the outer portions 39 are removed, whereas pin holes 56*c* are used if the outer portion R3 is required.

If the inner portion R1 of the ribbon positioning section 36 is used, the intermediate portion 33 and the outer portion 39 may be removed by cutting, bending, or otherwise removing the portion of the template along dividing lines 49. The dividing lines 49 can be reductions in the thickness of the plate, or perforations in the plate that allow the excess portions to be cut or sheared to reduce the length of the ribbon positioning portion 36. The template further comprises indicia used to help position the badges or awards on the template, thereby increasing the ease with which awards are arranged on the template 30. For example, indicia "RIFLE" is placed on the far left hand side of the badge positioning section 34 beneath a horizontal slot 47*a* designating the position of a badge awarded for rifle marksmanship. Similarly, indicia "PISTOL" is placed on the far right hand side of the badge positioning section 34 beneath a second horizontal slot 47*b* designating the position of a badge awarded for pistol marksmanship. Other indicia can be used for the particular application to assist the bearer in complying with certain regulations relating to the order and positioning of certain awards. Further, the template includes additional indicia to assist the user in aligning the template with the garment to be worn. For example, the letter "V" indicates a center of the template that can be aligned with the center of a pocket or other portion to the garment to center the arrangement. Further, dashed lines 99 can be used to align the top edge of a pocket or the like to establish a point of reference for placing the awards.

The medal positioning section 34 comprises two horizontal elongated slots 47*a*, 47*b* for locating the pins of two medals. The slots 47*a*, 47*b* are slightly offset vertically with slot 47*b* slightly higher than slot 47*a*, with a recessed portion 44 at the same vertical position as the slot 47*a*. In this way, a single medal may be centered by placing a first positioning pin in slot 47*a* and a second positioning pin in slot 47*b* at recessed portion 44 so that the medal will hang properly in a vertical orientation.

Figure 2:
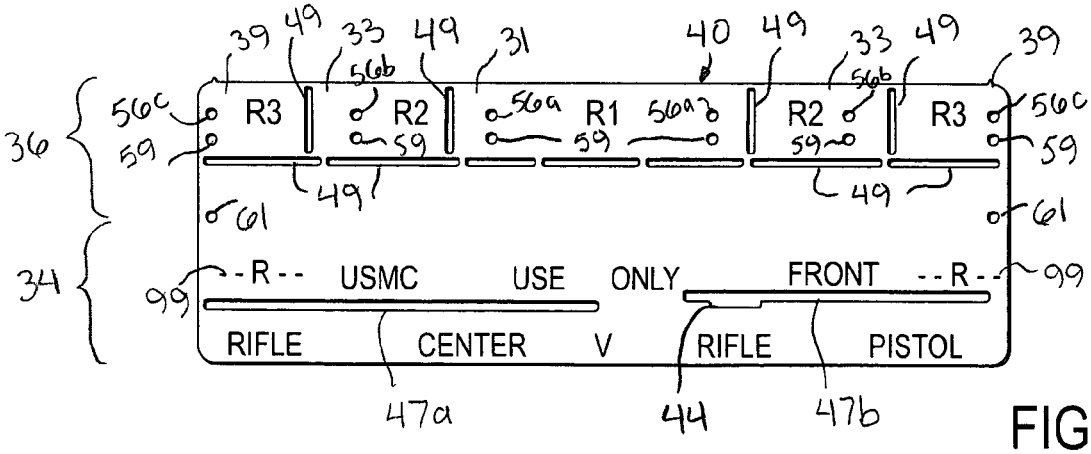
FIG. 2 is a front view of a template in accordance with a second embodiment of the present invention.

FIG. 2 illustrates a second template of the present invention comprising a variation on the template of FIG. 1, generally designated 40. The second template 40 is used to create an arrangement corresponding to what is commonly referred to as a Type 2 Alpha or Bravo style arrangement as illustrated. A Type 2 bracket supports 3 to 6 ribbons and optionally supports up to 2 badges. Template 40 includes three additional sets of pin holes 59 in the ribbon positioning section 36 serving as a supplement to pin holes 56 for adjusting the vertical spacing of a ribbon positioned thereon from the badge positioning section 34. This may also be necessary because the template 40 includes pin holes 61 at peripheral edges of the template for mounting a second ribbon above the badge positioning section 34. Other sets of pin holes similar to pin holes 61 can be added to the template to accommodate additional ribbons as a variation on the template 40 shown in FIG. 2.

Referring to FIGS. 5-8, the templates 30 and 40 are shown mounting various combinations of ribbons and badges. A conventional badge 201 is shown in FIG. 5 including a transversely projecting anchor bar 200 from which is suspended a figure piece 205 that symbolizes the award. The anchor bar 200 includes on its rearward facing surface a left hand pin and a right hand pin for piercing the user's garment 210. The badge is designed to be retained to the garment by attaching a push on clasp 220 over each pin. These clasps have a conventional structure. Here, the pins are passed through the template at horizontal slots 47*a*, 47*b* on the inside of the garment 210 to support and position the award in a predetermined position. The use of the recessed portion 44 ensures that the badge hangs evenly from the two slots 47*a*, 47*b*. A conventional ribbon 230 is generally channel shaped and fits over a track with the ribbon insignia displayed on the outer facing surface 235 of the track. On the rear side of the track, the pair of spaced apart opposing pins for piercing the user's garment 210 is typically welded as a fixed structure. As with the badge, a pair of push on clasps 225 are slid over and capture the pins on the inside of the user's garment to secure the ribbon 230 to the garment 210.

As one can appreciate, without the present invention the highly precise spacing of the ribbons 230 and badges 200 with respect to one another as well as the placement on the garment 210 itself can be a trial by error method that requires a significant amount of time to perfect. However, by using the template of the present invention, placement of the ribbons and badges can be done in a relatively short amount of time. For instance, measuring the required distance from the top of a shirt pocket to install a first set of ribbons and then adding another four rows of ribbons may require multiple attempts and can lead to significant frustration. With the present invention, however, the template is secured against an interior surface of the garment and the ribbons are simply laid over the outer surface of the garment. Then the pins of a first board are pushed through and the pin holes of the template guide the pins into place. The clasps 225 are then clamped onto the exposed pin ends to secure the ribbon 230 in the proper position. The next row is mounted in a similar manner. Using the template, a multi-row ribbon set up can be created quickly and with great precision.

Figure 5A:
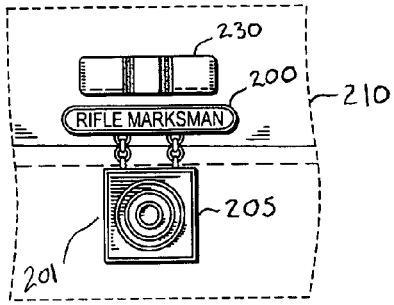
FIG. 5A is a front view of a single ribbon bar and single badge configuration secured to an external surface of a garment about the top edge of a pocket.
Figure 5B:
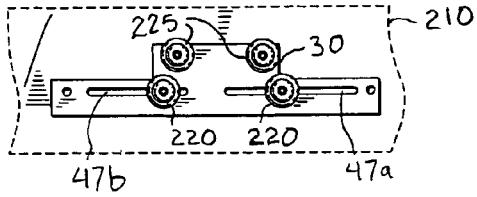
FIG. 5B is a rear view of the template of FIG. 1 with the outside sections removed for use with a single ribbon bar, single badge configuration of FIG. 5A and secured to an interior side of a garment.

As FIG. 5 further illustrates, a single ribbon 230 is mounted above a marksman medal 205 where push pins on the medal 205 and ribbon 230 pierce the material of a uniform. The template 30 is hidden from view behind the uniform as illustrated in FIG. 5B. The template 30 of FIG. 1 is used to mount the ribbon and medal of FIG. 5, where the intermediate portion 33 and outer portion 39 of the ribbon positioning section 36 have been removed along division lines 49 to minimize the size of the ribbon positioning portion 36 of the template 30. As discussed above, the divisions may be holes or perforations punched into the plate forming the bracket, or grooves that facilitate the removal of portions of the bracket by creating a weakness in the template along the grooves. Because only a single, smaller ribbon is mounted, sections corresponding to R2 and R3 are removed leaving the template illustrated in FIG. 5B. The ribbon is mounted using push pin holes 56*a* within the section corresponding to R1, and the medal is mounted using the indicia for "RIFLE" positioning the push pins at the designated location of the horizontal slots 47*a,b*. In this manner, the arrangement shown in FIG. 5A is quickly and precisely configured with no trial and error as to the location of the awards on the uniform of the bearer.

Figure 6A:
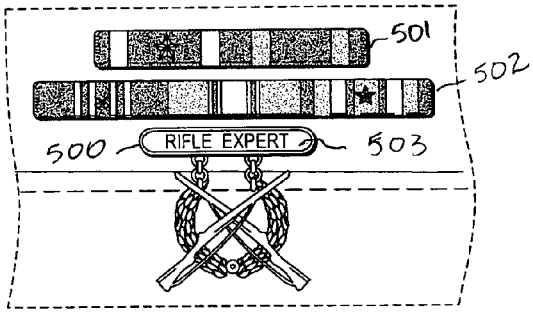
FIG. 6A is a front view of an exemplary double ribbon bar with dual ribbon and triple ribbon alignments and single badge with spacing.
Figure 6B:
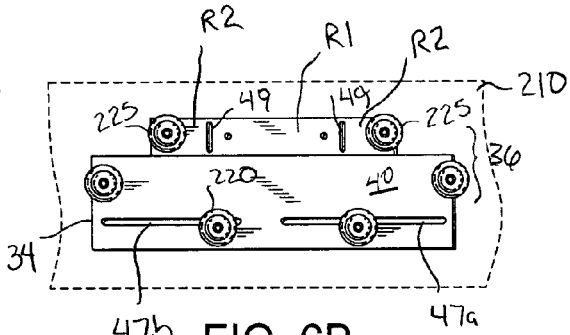
FIG. 6B is a rear view of the template of FIG. 2 with the outermost upper sections removed for use in conjunction with the ribbon and badge combination and spacing as illustrated in FIG. 6A.

FIG. 6 illustrates a dual ribbon, single badge configuration using the template 40 from FIG. 2. Using the intermediate portion 33 designated R2 to mount the upper ribbon 501, push pins are inserted into holes 56*b* and clasps 225 are placed on the push pins to mount ribbon 501 in the designated location. Using secondary pin holes 61, ribbon 502 is mounted below ribbon 501 where push pins pass through the designated holes to quickly establish the proper spacing of ribbon 502 between ribbon 501 and medal 503. Again, the pins of the rifle badge are positioned in the horizontal slots 47*a,b* of the badge positioning section 34 using the indicia for "RIFLE." That is, the pins on the anchor bar 500 of the badge pass through the horizontal slots and the badge is slid into position along the slot using the appropriate indicia, whereupon the clasps are placed on the back of the push pins to secure the badge in place.

Figure 7A:
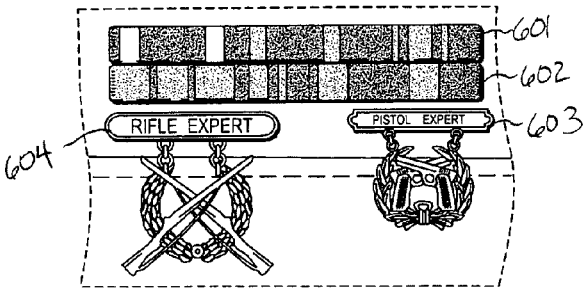
FIG. 7A is a front view of an exemplary ribbon and badge configuration with dual ribbon rows of three ribbons each and dual badges.
Figure 7B:
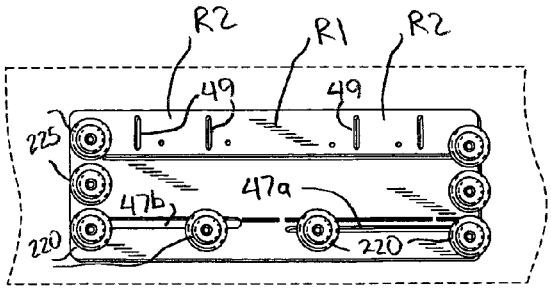
FIG. 7B is a rear view of the template in FIG. 2 for use in conjunction with the ribbon and badge combination and spacing as illustrated in FIG. 7A.

In FIG. 7, a dual ribbon, dual badge arrangement is shown where the upper ribbon 601 is inserted into the pin holes 56*c* of the template 40 and the lower ribbon 602 is inserted into the pin holes 61 of the secondary portion of the ribbon positioning section 36. A first badge 604 is positioned by inserting both pins into slot 47*a*, and a second badge 603 is positioned by inserting both pins into slot 47*b*. Clasps 220, 225 are used to lock the ribbons and badges in place as described previously.

Figure 8A:
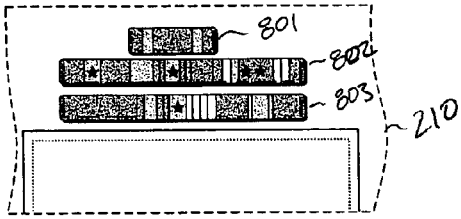
FIG. 8A is a front view of an exemplary triple ribbon bar lined up above the upper edge of a garment pocket with two triple ribbon bars and a single ribbon bar with ⅛ inch spacing.
Figure 8B:
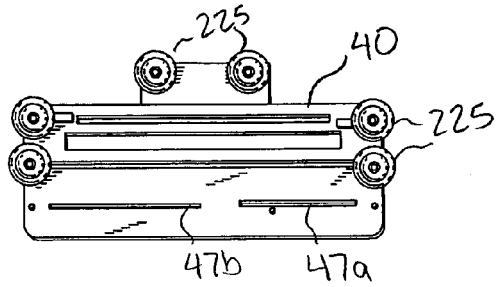
FIG. 8B is a rear view of the template of FIG. 2 with the outer portions removed for use in conjunction with the ribbon and badge combination and spacing as illustrated in FIG. 8A.

In FIG. 8, a triple ribbon arrangement is used with the template 40, where the horizontal slot 47 reserved for badges is instead used as a third ribbon mounting mechanism. Here, as shown in FIG. 8A all three ribbons 801, 802, 803 are positioned above the pocket edge with no badges provided in this arrangement. Intermediate portion 33 and outer portion 39 of the template has been removed in the example of FIG. 8 leaving the R1 ribbon positioning portion only. The first ribbon 801 is mounted in pin holes 56*a* of R1 (FIG. 1), the second ribbon is mounted in pin holes 61 (FIG. 2), and the third ribbon is mounted in horizontal slots 47*a,b*. Alternately, ribbon 803 can be located in a second set of pin holes formed in the template above the badge positioning section 34.

Figure 3:
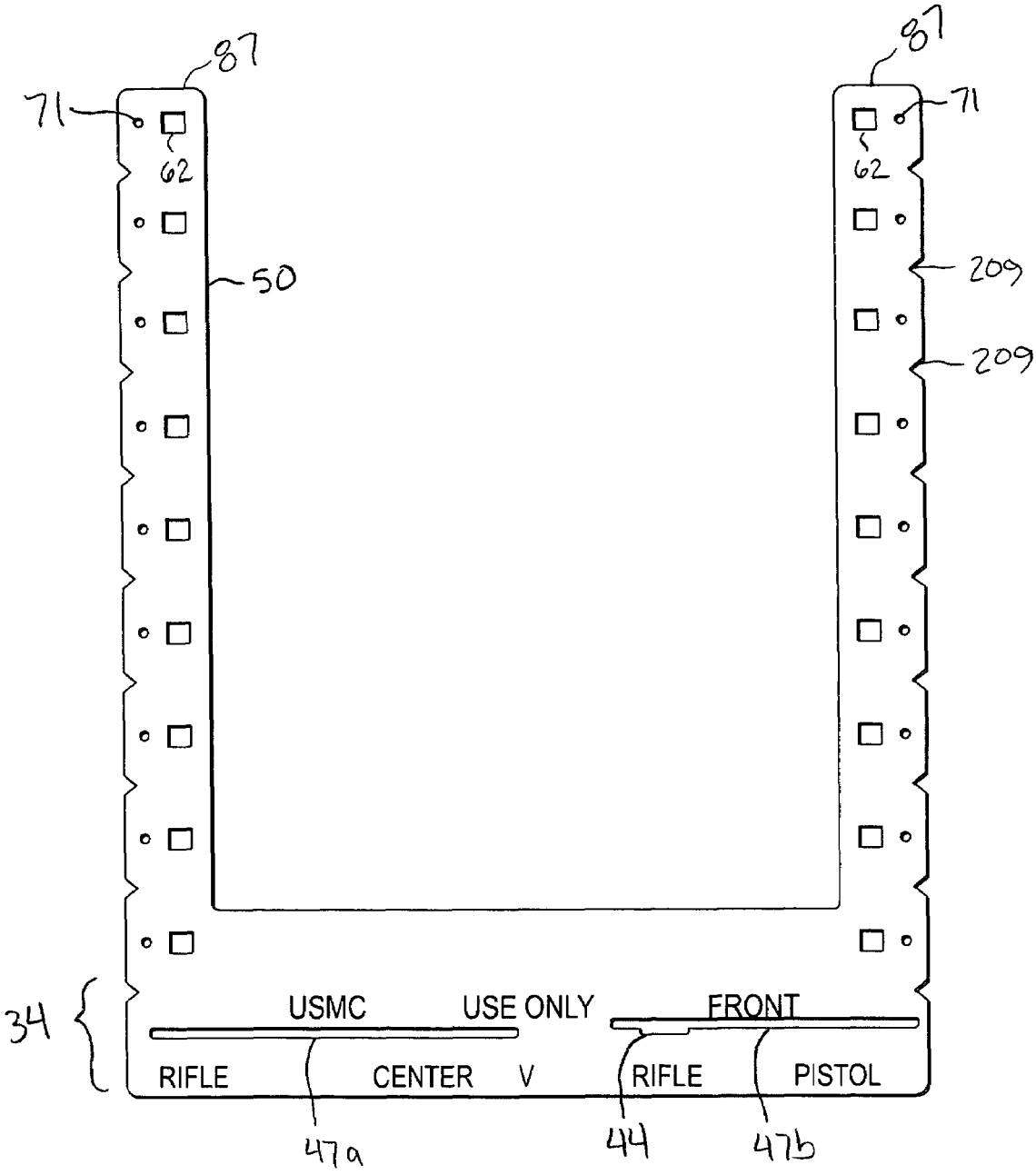
FIG. 3 is a front view of a template in accordance with a third embodiment of the present invention.

If more than six ribbons are to be mounted to the uniform, then the template of FIG. 3 may be employed, commonly referred to as a Type 3 Alpha style arrangement. The bracket of FIG. 3 is generally U-shaped with the based or bottom portion comprising the badge or medal positioning section 34 with mounting slots 47*a,* 47*b* as previously illustrated in FIGS. 1 and 2, and the uprights 87 of the U-shaped bracket support a plurality of ribbons in a stacked configuration. The height of the uprights 87 can be adjusted by removing bendable or frangible cells 209 as needed. Type 3 brackets support from 7 to 23 ribbons and optionally supports up to two badges. Each cell of the upright includes a pin hole 71 for receiving a pin on a medal, and a square window 62 for receiving a bendable tab on an auxiliary support bar that mounts to the template 50. The auxiliary bars can be used to replicate the ribbon positioning section 36 of the templates 30, 40, or to extend or reduce the length of the row for the ribbons to accommodate elements of the uniform or to mount non-uniform size ribbons.

Figure 4A:
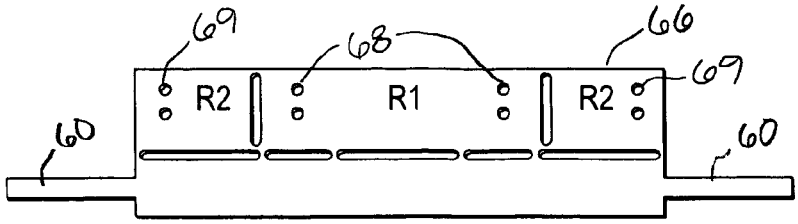
FIG. 4A is a front view of an exemplary auxiliary support bar for displaying a three across ribbon display for use in conjunction with the template illustrated in FIG. 3.

FIGS. 4A-4E illustrate various types of auxiliary bars. For example, FIG. 4A illustrates an auxiliary support bar 66 that coincides with the ribbon positioning section 36 of the template 40, with elongated extensions 60 that form bendable tab. The tabs 60 can be inserted into the square window 62 of the template 50 and bent back to releasably secure the auxiliary bar 66 to the template 50. Along each cell of the template 50 a separate auxiliary support bar 66 can be coupled so that the template can be tailored to the exact number and size of the awards to be displayed. A first ribbon can then be pinned on the auxiliary support bar 66 in pin holes 68 or 69, similar to the method described above, or pin holes 71 on the template 50 can be used in conjunction with the pin holes on the auxiliary support bar 66. Using multiple auxiliary support bars 66, a large number of ribbons can be arranged on the template 50 with precise spacing and alignment.

Figure 4B:
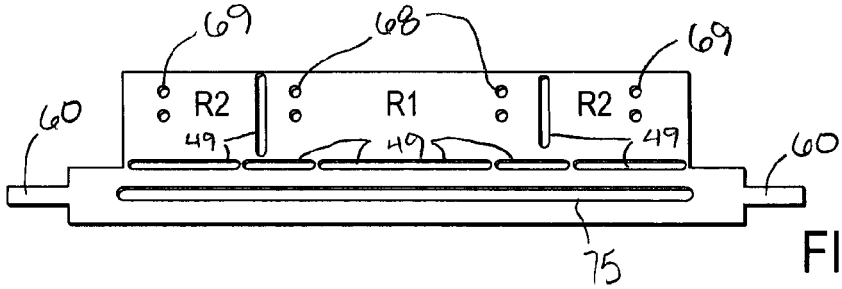
FIG. 4B is a front view of an exemplary auxiliary support bar for displaying a four across ribbon display for use in conjunction with the template illustrated in FIG. 3.
Figure 4C:
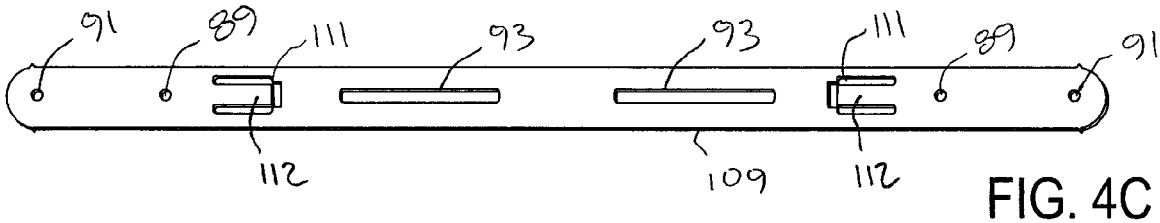
FIG. 4C is a front view of an exemplary auxiliary support bar for adding rigidity to the template illustrated in FIG. 3.
Figure 4D:
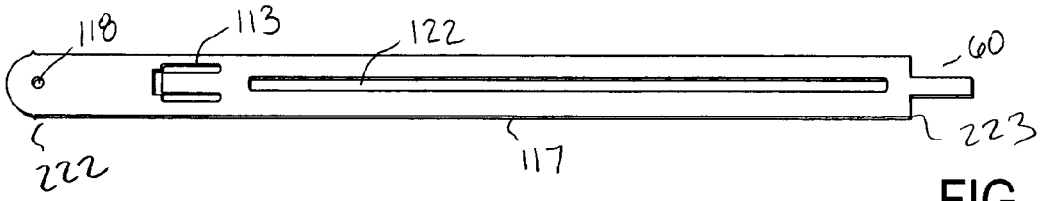
FIG. 4D is a front view of an exemplary auxiliary ribbon row reducer for use in conjunction with the template illustrated in FIG. 3.
Figure 4E:
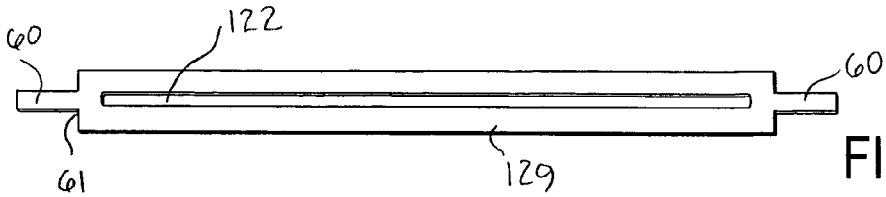
FIG. 4E is a front view of an exemplary auxiliary ribbon bar for use in conjunction with the template illustrated in FIG. 3.
Figure 9A:
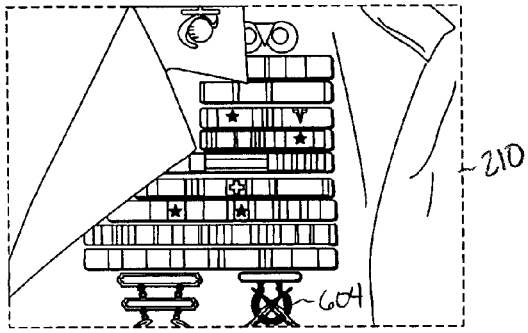
FIG. 9A is a front view of an exemplary nine high ribbon bar with dual badge configuration.
Figure 9B:
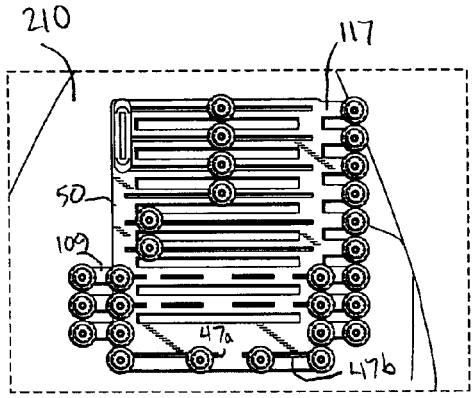
FIG. 9B is a rear view of the template in FIG. 3 with attached auxiliary bars for use in conjunction with the ribbon and badge combination and spacing as illustrated in FIG. 9A.

FIG. 4B is a variation of the auxiliary support bar 66 of FIG. 4A further including a single elongated horizontal slot 75 formed below section lines 49 and pin holes 69 of the three across template embodiment to alternatively position a ribbon in an offset horizontal position, to accommodate a ribbon of non-standard width in the spacing of the support pins, or to support additional badges. FIG. 4C illustrates an auxiliary bar 109 that can extend the ribbon support laterally outside of the template uprights 87 and provides two sets of pin holes 89, 91. Either pin hole 89,91 can be used in conjunction with a corresponding horizontal slot 93 or template pin holes 71 to secure a ribbon to the outer periphery of the auxiliary support bar 109 and then using alternate holes 91 in combination with horizontal slots 93 to position a ribbon off center from the centerline of the bracket 50. The extended auxiliary support bar 109 can be connected to the template 50 using outwardly facing bracketing members 111 that engage the square windows 62 of the template 50 using a bendable tab 112 to fix the auxiliary bar therebetween. As shown in FIG. 9, the use of an offset arrangement may be necessary to account for a collar on the uniform or to locate two ribbons side by side on the same horizontal line. FIG. 4D illustrates a single sided version of the extension auxiliary bar where a first end 222 has a bracketing member 113 facing inwardly for engaging a square window 62 on the template 50, and a bendable extension 60 on an opposite side 223 that can be inserted into a square window 62 of template 50 to secure the auxiliary support bar 177 thereto. The auxiliary support bar 117 of FIG. 4D has a pin hole 118 that cooperates with a pin hole 71 on the template 50. In FIG. 4E, both sided are equipped with a bendable extension 60 that fit into the square windows 62 of the template 50 to secure the support bar thereto, and further includes a single horizontal slot 122 used to locate a badge or ribbon in place of one or more pin holes.

Figure 10A:
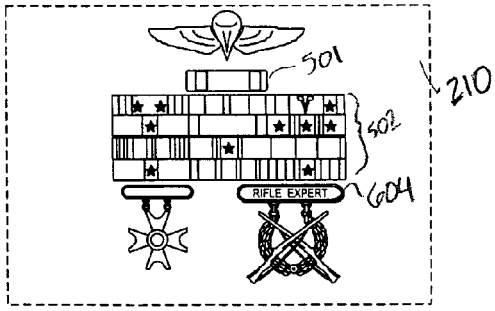
FIG. 10A is a front view of an exemplary quintuplet bar and dual badge configuration.
Figure 10B:
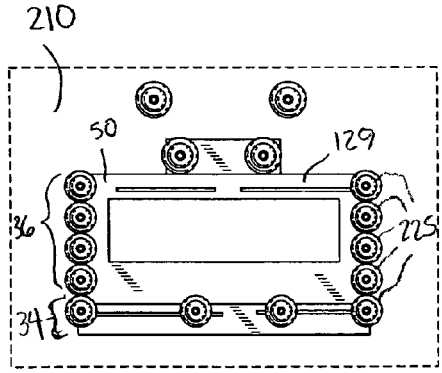
FIG. 10B is a rear view of the template in FIG. 3 cut down and including an auxiliary ribbon bar securing the exemplary ribbon and badge configuration illustrated in FIG. 10A.

FIGS. 9 and 10 illustrate the template 50 of FIG. 3 in conjunction with various auxiliary support bars of FIG. 4 to demonstrate the various ways in which support bars can be used to create multiple arrangements of ribbons and badges.

In use, the medal wearer lays out the garment (shirt or jacket) on a flat surface. The template is trimmed as necessary to accommodate the required number of ribbon bars to be worn. For example, assuming a two ribbon bar display on a particular row, the extra end pieces indicated by the indicia R2 and R3 that make up a three bar holder may be broken off by hand or removed using a suitable cutting instrument. If both ribbon bars and badges will be worn, the supporter is placed flush and centered above the left pocket. Conveniently an indicia such as a "V" indicating the center of the supporter may be used. If wearing only ribbons, then the template is positioned over the left pocket so that the dashed lines 99 line up with the top edge of the pocket. Once the template is in position, the user takes pencil and marks the placement of the ribbon bar and badges, if applicable, on the shirt or jacket. For example, a pencil mark is placed through pin holes at 56*a* for the placement of the ribbon. The placement pins of the ribbons are inserted through the pencil marks to align the badge. The template is then placed on the inside surface of the jacket or shirt. The corresponding holes used to mark the pencil marks on the outside of the garment are slid over the inwardly extending pins. Then each pin receives a clasp to capture the pin and secure the template against the inside surface of the garment. In this manner, the arrangement of the awards on the uniform correspond precisely with the spacing and order of the template to create an arrangement that complies with the regulations and maintains proper spacing and positioning for repeated wearings.

The foregoing discussion is meant to be illustrative of the present invention but not limiting in its scope. Rather, one of ordinary skill in the art would appreciate that many variations to the above described embodiments are possible without deviation from the spirit of the invention, and such variations should be deemed within the scope of the invention. Therefore, the invention is properly limited only by the plain and ordinary meaning of the words used in the claims appended below, as the inventor had not attempted to limit the scope of the invention in any manner in the foregoing discussion.

What is claimed is:

1. A ribbon template device for attaching inside the front of a military uniform blouse garment to selectively mount a plurality of military ribbons carried on elongated bars having respective sets of rearwardly projecting mounting pins spaced apart respective selected distances, to position the ribbons in a predetermined vertically spaced pattern, the ribbons being of a predetermined width and the pins being sized to receive fasteners, the template device comprising:

an elongated planar template to be positioned against the inside surface of the blouse garment and including a plurality of sets of positioning holes spaced horizontally from one another to receive the sets of pins of the respective bars, the sets of positioning holes being spaced vertically from one another to, upon the respective sets of pins of the ribbon bars being inserted through the garment into the respective sets of positioning holes, space the ribbons disposed in the predetermined vertically spaced pattern whereby the template may be positioned on the inside surface of the blouse garment and the respective sets of pins inserted through the garment and the respective sets of holes to position the respective ribbons in the predetermined vertically spaced pattern and the fasteners attached to the respective pins to hold the template and ribbons in place.

2. The template device as set forth in claim 1 wherein:

the holes are spaced apart to display the ribbons spaced ⅛ inch apart.

3. The template device as set forth in claim 1 that includes:

at least one of the holes of at least one set is an elongated slot.

4. The template device as set forth in claim 1 wherein:

the template is constructed of brass.

5. The template device as set forth in claim 1 wherein:

the template includes, a plurality of horizontally slots spaced a predetermined distance below the holes for receiving pins of bars mounting military badges to be spaced a specified distanced below the ribbons.

6. The ribbon template as set forth in claim 1 wherein:

the individual fasteners and are constructed to cover the free ends of the respective pins.

7. In combination, a ribbon template device for maintaining ribbons in a predetermined vertically spaced pattern, the device comprising:

military uniform blouse garment having a front panel;

a plurality of elongated mounting bars on the outside surface of the panel and having respective sets of rearwardly projecting mounting pins spaced horizontally apart at respective selected distances, to project through the panel to leave exposed ends;

ribbons of a predetermined width on he respective bars; and an elongated planar template positioned against the inside surface of the panel and including a plurality of sets of positioning holes spaced horizontally from one another and the respective selected distances and receiving the respective sets of pins of the respective bars, the sets of positioning holes being spaced vertically from one another to space the ribbons disposed in the predetermined vertically spaced pattern; and removable fasteners secured behind the template over the exposed ends of the respective pins.

* * * * *